US006929454B2

(12) United States Patent
Münzenmaier et al.

(10) Patent No.: US 6,929,454 B2
(45) Date of Patent: Aug. 16, 2005

(54) THICK MATTER PUMP

(75) Inventors: Werner Münzenmaier, Nürtingen (DE); Wolf-Michael Petzold, Aichwald (DE)

(73) Assignee: Putzmeister Aktiengesellschaft, Aichtal (DE)

( * ) Notice: Subject to any disclaimer, the term of this patent is extended or adjusted under 35 U.S.C. 154(b) by 0 days.

(21) Appl. No.: 10/333,807

(22) PCT Filed: Jun. 28, 2001

(86) PCT No.: PCT/EP01/07415

§ 371 (c)(1),
(2), (4) Date: Jan. 24, 2003

(87) PCT Pub. No.: WO02/08605

PCT Pub. Date: Jan. 31, 2002

(65) Prior Publication Data

US 2003/0170127 A1 Sep. 11, 2003

(30) Foreign Application Priority Data

Jul. 24, 2000 (DE) ..... 100 36 202

(51) Int. Cl.[7] ..... F04B 35/02

(52) U.S. Cl. ..... 417/403; 417/63; 417/400; 417/342; 417/344; 417/345; 417/347

(58) Field of Search ..... 417/342, 244, 417/339, 63, 900, 399, 400, 403, 344–347

(56) References Cited

U.S. PATENT DOCUMENTS

| | | | | | |
|---|---|---|---|---|---|
| 3,994,627 | A | * | 11/1976 | Calzolari | 417/317 |
| 4,490,096 | A | * | 12/1984 | Box | 417/342 |
| 5,332,366 | A | * | 7/1994 | Anderson | 417/63 |
| 5,344,290 | A | * | 9/1994 | Benckert | 417/342 |
| 5,458,470 | A | * | 10/1995 | Mannhart et al. | 417/517 |
| 6,100,608 | A | * | 8/2000 | Takahashi | 307/125 |
| 6,171,075 | B1 | * | 1/2001 | Munzenmaier et al. | 417/342 |
| 6,299,416 | B1 | * | 10/2001 | Kwag | 417/403 |
| 6,454,542 | B1 | * | 9/2002 | Back | 417/53 |
| 6,712,587 | B2 | * | 3/2004 | Gerhardt et al. | 417/390 |

FOREIGN PATENT DOCUMENTS

| | | | | |
|---|---|---|---|---|
| DE | 38 34 678 | | 4/1990 | F04B/15/02 |
| DE | 197 16 030 | | 3/1998 | F04B/15/02 |
| DE | 19716030 C1 | * | 3/1998 | F04B/15/02 |
| EP | 0 446 206 | | 7/1989 | F04B/7/02 |
| WO | WO 90/06444 | | 6/1990 | F04B/7/02 |

* cited by examiner

*Primary Examiner*—Cheryl Tyler
*Assistant Examiner*—Emmanuel Sayoc
(74) *Attorney, Agent, or Firm*—Pendorf & Cutliff

(57) ABSTRACT

In a thick matter pump, especially for delivering concrete, comprising two delivery cylinders, it is known to provide two position sensors in one of the two cylinders for control of the pistons. However, leakage of hydraulic fluid can lead to an imbalance of the two cylinders. In the invention two position sensors (52', 52") are provided, which are arranged at a defined distance from one of the ends of the drive cylinders and which respond to a drive piston (30', 30") that is passing by. To prevent the formation of concrete clots inside the delivery cylinders (10) and to prevent the occurrence of a slamming when the drive pistons (30', 30") reach their end of travel, the invention provides that both position sensors (52', 52") are arranged at a distance from the piston rod-side ends of both drive cylinders (24', 24") and, in addition, a correcting sensor (54) is arranged at a defined distance from the piston head-side end of one of the drive cylinders (24'). This correcting sensor can be temporarily activated for initiating a reversing process overruling the rod-side position sensor (52") of the other drive cylinder (24").

12 Claims, 4 Drawing Sheets

THICK MATTER PUMP

CROSS REFERENCE TO RELATED APPLICATION

This application is a national stage of PCT/EP01/07415 filed Jun. 28, 2001 and based upon DE 100 36 202.8 filed Jul. 24, 2000 under the International Convention.

BACKGROUND OF THE INVENTION

1. Field of the Invention

The invention concerns a thick matter pump, with two delivery cylinders communicating with a material feed basin via openings situated on an end face, with two hydraulic drive cylinders connected to a reversible hydraulic pump via connections at the piston rod side or piston head side, with a swing oil line connecting the drive cylinder ends opposite to the pump with each other, the drive pistons of the drive cylinders and the delivery pistons of the delivery cylinders being pair-wise rigidly connected with each other via common piston rods, with equalizing lines connected in the area of the two ends of the drive cylinders bridging over the drive pistons at their respective end positions and containing a check or back pressure valve, and with two position sensors provided a defined distance from one of the ends of the drive cylinders, connected to a control device and emitting an end position signal as the associated piston passes by, for controlling the reversal of the hydraulic pump.

2. Description of the Related Art

Two-cylinder thick material pumps of this type are known, in which the two position sensors are provided on one of the two drive cylinders (EP-B 0 446 206). On the other drive cylinder no monitoring of the end position is carried out. It has been found that, depending upon the pressure relationships existing within the cylinder, leakages bypassing the piston can occur, which result in an accumulation of swing oil or in a loss of swing oil, which in turn can result in an advancing or retarding of one of the pistons.

Thus, for example in the case that low oil pressure oil is being supplied to the piston rod side, as for example during the cleaning operation with water, there may result an accumulation of swing oil. This leads thereto, that the piston in the second cylinder is caused to advance, as a result of which this piston when in the end position can come into an undesired slamming mechanical contact with the cylinder. On the other hand, in the case of a high-pressure operation, that is, in the process of thick material conveyance, there can result a loss of swing oil loss as a consequence of a leakage oil bypassing the piston. Thereby in the second cylinder the piston stroke is shortened, so that in the delivery cylinder a clot or plug—hardened concrete—can form. This concrete clot is not pushed out of the delivery cylinder but rather is sucked back in during each suction stroke of the delivery cylinder. It eventually hardens and leads to an elevated friction wear in the delivery cylinder.

In the case of the piston head side connection of the drive cylinder to the hydraulic pump, there results in the low-pressure operation a loss of swing oil. This results in advancing of one of the pistons and in the undesired end-position slamming of the piston in the second cylinder. In high-pressure operation there results in this situation an accumulation of swing oil, which due to the premature switching-over in the first cylinder, can lead to development of a plug in the second cylinder with the above described disadvantages.

SUMMARY OF THE INVENTION

Beginning therewith, it is the task of the invention to provide a sensor arrangement in a thick material pump of the type described in the above introductory portion, which prevents both the end position slamming in the case of low pressure operation as well as clot formation in high pressure operation.

The solution of this task is proposed by the combination of characterizing features set forth in Patent Claim 1. Advantageous embodiments and further developments of the invention can be seen from the dependent claims.

The inventive solution is based upon the idea that, by an appropriate arrangement of position sensors on the drive cylinders, a clot development in the delivery cylinders as well an end positioning slamming can be avoided, while with supplemental correcting means an automatic stroke equalization can be achieved. In order to achieve this, it is proposed in accordance with the invention, that the two position sensors are positioned at a specified distance from the piston rod side ends of both drive cylinders, and that in addition a correction sensor is provided at a defined distance from the piston head end of one of the drive cylinders, which in place of the piston rod sided position sensor of the other drive cylinder for a time is activateable for triggering a reverse process. The correction sensor thereby has the task, of carrying out an automatic stroke correction, when the drive piston in the concerned drive cylinder no longer passes over the position of the correction sensor, when on the basis of an internal leakage oil situation this results in a stroke shortening.

Preferably, the correction sensor is activated in defined time intervals respectively for one reversal process. In a preferred embodiment of the invention the requisite amount of reversal occurs. This can occur thereby, that the correction sensor is activateable in the case of a missing piston signal from the correction sensor and the existence of a piston signal of the position sensor associated with the oppositely lying drive cylinder. Therein it has been found to be of advantage, when the control device includes a delay circuit or delay software with a time constant corresponding to at least twice the stroke time of the drive piston for activation of the correction sensor, which is triggered upon missing a piston signal of the correction sensor and the existence of a piston signal at the oppositely lying drive cylinder associated piston sensor, and is reset upon occurrence of the piston signal at the correction sensor. In many application situations it is however sufficient, when the correction sensor is activateable in defined time intervals respectively for one reverse process.

For enhancing the operational reliability it has been found to be of advantage, when respectively two redundant position sensors are provided on the piston rod side.

The position sensors and the correction sensor can be proximity switches or magnetic switches for detecting the passage of the piston in the direction towards the end position, which can be directly connected to the reverse oil flow circuit. It is however basically also possible to provide the position sensors and the correction sensor as signal emitters, which emit an end position signal during the passage by of the piston in the direction towards the end position.

The hydraulic pump is preferably a reversing pump, in particular a slant disc axial piston pump. The same purpose can be accomplished also by a unidirectional conveying hydraulic pump. In this case the pump connections of the drive cylinder are connected with the hydraulic pump via a directional valve.

In principle it is also possible to provide two or more hydraulic pumps, which are connectable to the drive cylinder in parallel arrangement.

BRIEF DESCRIPTION OF THE DRAWINGS

In the following the invention will be described in greater detail on the basis of an illustrative embodiment shown in the figures in schematic manner. There is shown in FIG. 1 a two cylinder thick material pump in partial sectional diagrammatic representation.

DETAILED DESCRIPTION OF THE INVENTION

Figure 1:
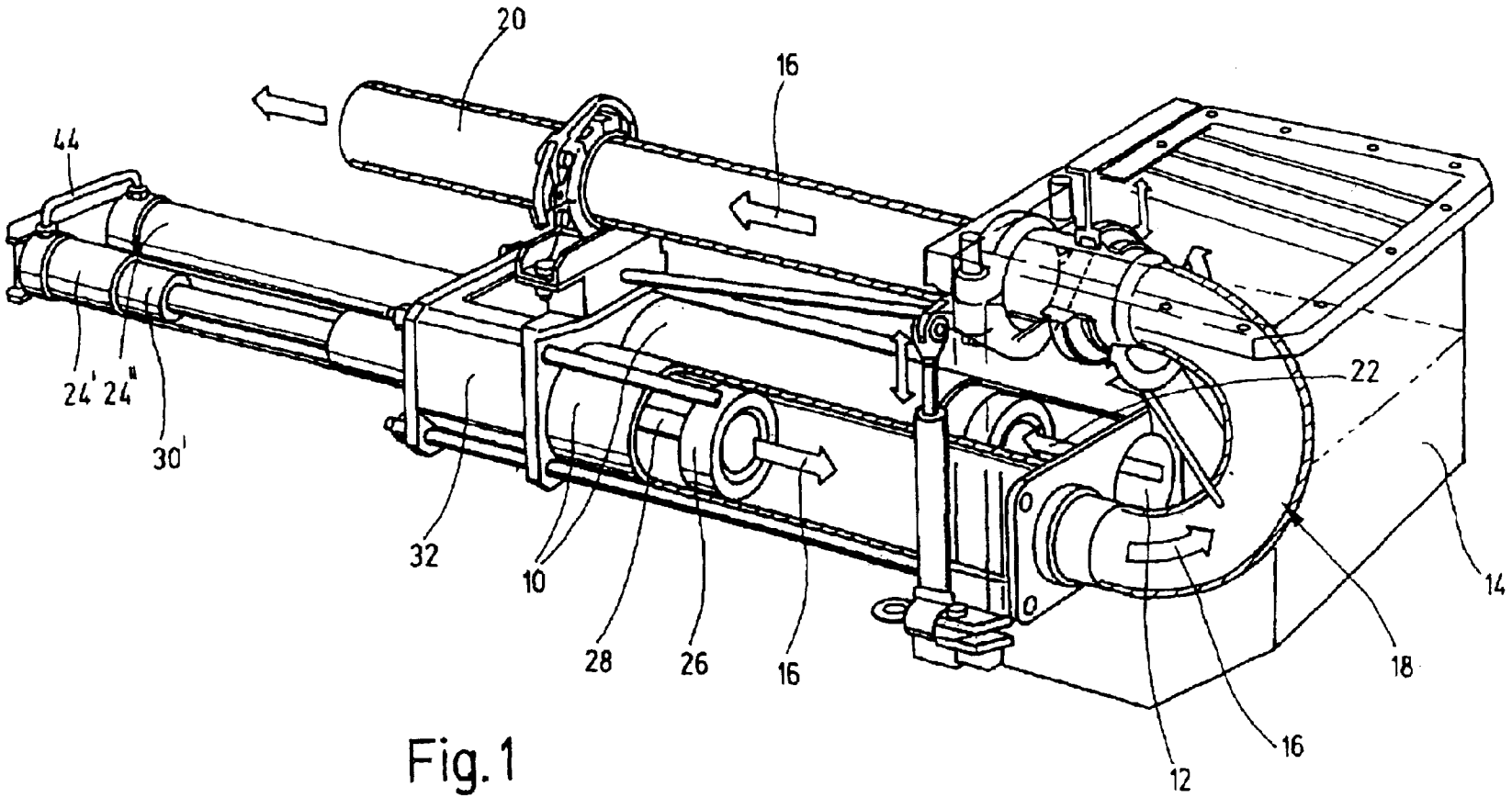

The thick material pump shown in FIG. 1 is comprised essentially of two delivery cylinders 10, of which openings 12 at one end communicate alternatingly with a material feed basin 14, which during the pressure stroke (arrow 16) are connectable via a pipe switch 18 with a transfer line 20 and during the suction stroke (arrow 22) are open towards the material feed basin 14 with suctioning in of material. The delivery cylinders 10 are driven in counter-stroke via the hydraulic drive cylinders 24', 24". For this purpose the delivery pistons 26 are connected via a common piston rod 28 with the drive pistons 30', 30" of the drive cylinders 24', 24". In the area between the delivery cylinders 10 and the drive cylinders 24', 24" there is a water box 32, through which the piston rods 28 extend.

The drive cylinders 24', 24" are connected at piston rod sided connections 34', 24" (FIGS. 2*a,b*) or piston head sided connections 36' 36" (FIGS. 3*a,b*) via pressure lines 38', 38" with the hydraulic connections 40', 40" of a hydraulic pump 42 which is driven via a motor 43, and the drive cylinders communicate with each other on the side lying oppositely to connections 36', 36", or as the case may be 34', 34" via a swing oil line 44. For the purpose of the stroke correction there is provided on the two ends of the drive cylinders 24', 24" respectively an equalizing line 48 containing a check valve 46 and bridging over the concerned drive piston 30', 36" in its end position.

In the illustrative embodiment shown in FIGS. 2 and 3 there is respectively provided a hydraulic pump 42 in the form of a reversing pump. The direction of movement of the drive pistons 30', 30" and therewith the delivery piston 26 is reversed thereby, that the slant disc 50 of the reversing pump 42, triggered by a reversal signal, is pivoted through the zero or neutral position and therewith the conveyance direction is changed to be pressure-less in the lines 38', 38". The conveyed amount of the reversing pump 42 is determined by the slant angle of the slant disc 50, which has a predetermined rotational speed. For triggering the reversal process, position sensors 50', 50" are provided at the piston rod sided ends of the drive cylinders 24, 24', which give off end position signals for the reversal of the reversing pump 42 upon the passage-by of the drive pistons 30', 30". The slant disc 50 of the reversing pump 42 is for this purpose connected to a control device 51, in which the end position signals emitted by the position sensors 52', 52" are evaluated. The position sensors 52', 52", located on the piston rod side ensure that the delivery piston 26, during each conveyance stroke, reach to the immediate vicinity of the opening 12 so that a concrete clot cannot form. In addition a correction sensor 54 is provided in the vicinity of the piston head side end of the one drive cylinder 24', which in place of the piston rod sided position sensor 52" of the other drive cylinder 24" is activateable via the control device 51 for a time for triggering a reversing process.

Figure 2A:
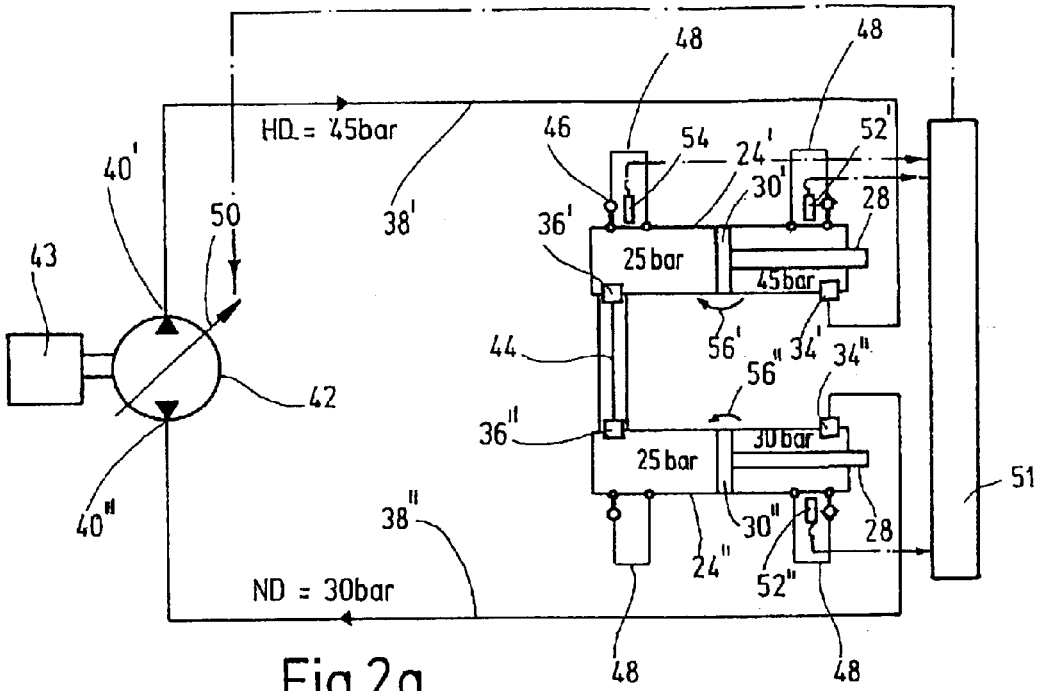
FIGS. 2*a* and *b* a schematic of the drive hydraulic for the thick material pump, with reversing pump connected to the piston rod side, with symbolic arrow representation of the leakage flow during low pressure and high pressure operation.

Since the drive pistons 30', 30" do not lie absolutely fluid-tight in the inner surface of the drive cylinder 24', 24", there can occur leakages within the drive cylinder 24', 24" during operation according to the magnitude of the piston rod sided and piston head sided pressure differentials existing in the cylinder space. In FIGS. 2*a,b* and 3*a,b* there are provided respectively for the low pressure operation (empty operation or cleaning operation) and high pressure operation (thick material conveyance) typical pressure values for the piston rod sided and piston head sided cylinder space, which lead to a leakage oil flow in the drive piston 30', 30". The leakage flow occurring on the basis of the pressure differential is symbolically quantified by the length of the curved arrow 56', 56". In FIGS. 2*a* and 3*a* the typical pressure relationships during low pressure operation are given, while in FIGS. 2*b* and 3*b* typical pressure values during high pressure operation are given. The pressure relationship in the drive cylinders 24', 24" can be calculated from the pressure in the pressure lines 38', 38" with consideration of the piston surface on the piston head side and the piston rod side.

In the case of the exemplary pressure relationships shown in FIG. 2*a*, as they could occur in the lower pressure range during piston rod sided driving, there results both in the suction direction (drive cylinder 24') as well as in the pressure direction (drive cylinder 24") a leakage arrow flow 56', 56" in the direction of the swing oil circuit 44. In both drive cylinders 24', 24" there thus results a swing oil accumulation. Since the reversing of the reverseable pump 42 regularly occurs via the position sensors 52', 52" provided on the piston rod side, there eventually builds up an over-supply of swing oil despite the overflowing by via the equalizing line 48, which finally leads thereto, that the drive pistons 30', 30" prior to reaching the piston side cylinder end are reversed in the direction of movement. This process can be monitored via the correction sensor 54. As soon as the drive piston 30' no longer reaches the correction sensor 54 in its movement stroke, the correction sensor 54 for the reversing process is activated via the not shown control device, following passage of a delay time, and the position sensor 52" is turned off. Thereby in the piston rod sided position of the drive piston 30", swing oil is urged via the adjacent equalizing line 48 to the low pressure side of the pressure line 38", until the drive piston 30' reaches its piston sided end position. In this manner one achieves in the course of a single reversing process via the correcting sensor 54 an automatic stroke correction or balancing.

Figure 2B:
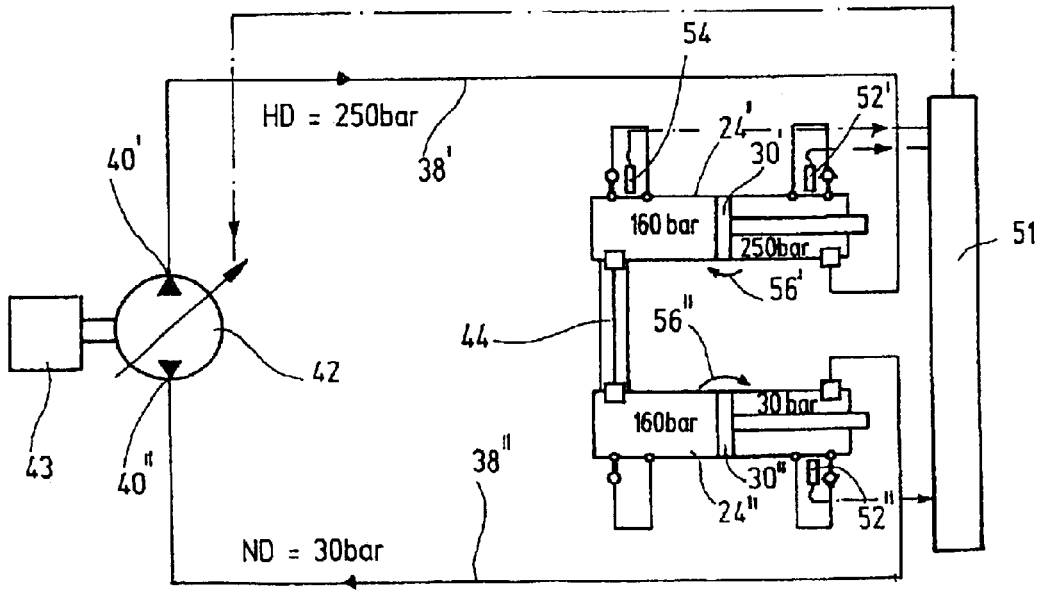
Figure 3A:
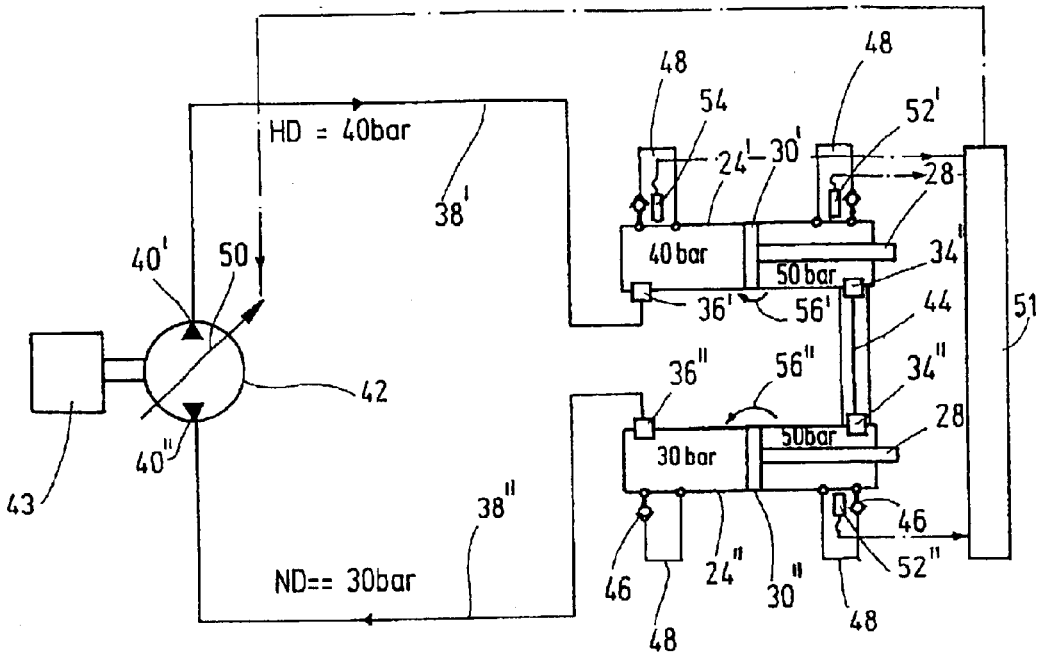
FIGS. 3*a* and *b* a schematic of the drive hydraulic with reversing pump connected to the piston head side in a representation according to FIGS. 2 and *b;*

During high pressure operation according to FIG. 2*b* there results from the pressure relationship, indicated there for illustrative purposes, during suction operation (drive cylinder 24') a swing oil accumulation in the direction of the arrow 56' and during pressure operation (drive cylinder 24") an swing oil loss in the direction of the arrow 56". Overall there results a loss of swing oil on the basis of the given pressure relationships. This means, that the sucking piston respectively reaches a piston head side end position before the pushing piston has reached its piston rod sided end position. Since the piston reversal occurs via the piston rod sided position sensor 52', 52", there results in the suction side a balancing flow via the balancing line 48, which pushes the pressing piston in its piston rod sided end position up to the position sensor 52', 52". The stroke correction occurs thereby exclusively via the balancing line 48 so that the correction sensor 54 during high pressure operation in any case is given a monitoring function, however no reverse function.

During piston sided driving according to FIGS. 3*a* and *b* the swing oil line 44 is connected to the piston rod sided connections 34', 34". In accordance therewith there results the following operating behavior.

During low-pressure operation according to FIG. 3*a* in both cylinders 24', 24" piston rod sided leakage oil flows into the piston head sided cylinder space with a consequence of a swing oil loss. On the basis of the reversing caused by the rod sided position sensors 52', 52" there results therefrom a gradual stroke shortening. The stroke shortening can be monitored externally by the correction sensor 54. As soon as the drive piston 30' no longer reaches the correction sensor during the reversing process via the position sensor 52", there is, following passage of a delay time, a reversal triggered one time via the correction sensor 54 during switched off position sensor 52". Thereby the stroke of the drive piston 30' is extended, while the drive piston 30" is already located in its piston rod sided end position. In this condition pressure oil is conveyed via the drive cylinder 24" over the piston rod sided equalizing line 28 to the swing arrow side, until a stroke equalizing or balancing is accomplished. For each stroke balancing only one reverse cycle via the correction sensor 54 is required.

Figure 3B:
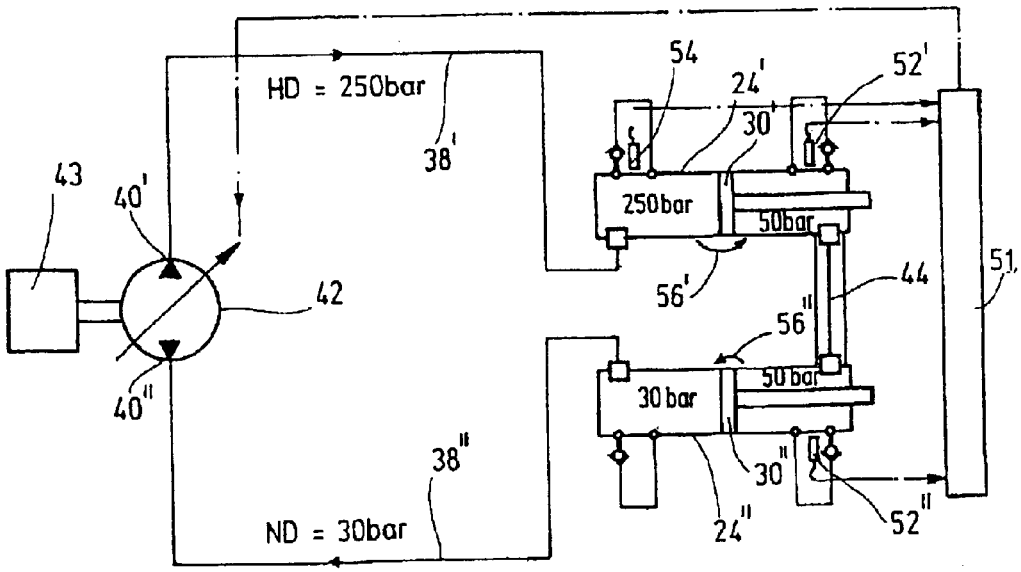

During high pressure operation according to FIG. 3*b* there results during each stroke process a swing oil accumulation at the piston rod side. This results from the sum of the two leakage flows, which are symbolically indicated by the length of the arrows 56', 56", in the figure. Since the reversing of the reversing pump is triggered in normal operation via the piston rod sided position sensors 52', 52", the piston driven by the swing oil always reaches it piston head sided end position before the directly driven piston reaches the associated piston rod sided position sensor. The stroke balancing or equalizing occurs here also continuously via the piston head sided equalizing line 48, so that the correction sensor 54 in the high pressure operation is given only a monitoring function and no correction function.

Figure 4:
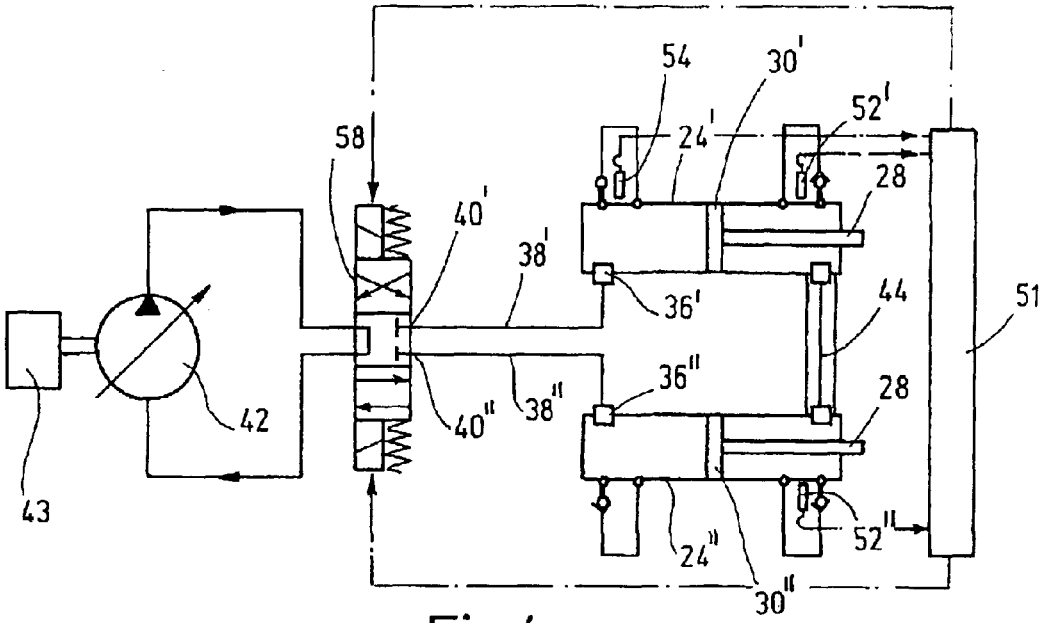
FIG. 4 a schematic of the drive hydraulic for the thick material pump with unidirectional hydraulic pump connected on the piston head side and redirectable via a directional valve in closed hydraulic circuit.
Figure 5:
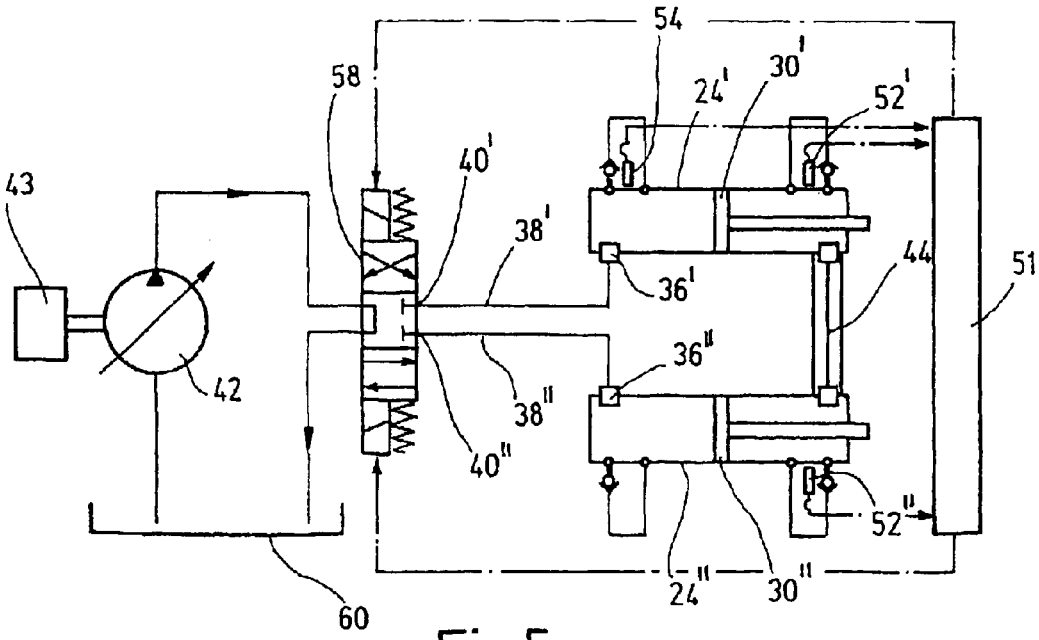
FIG. 5 a drive hydraulic according to FIG. 4 with open hydraulic circuit.

The illustrated examples according to FIGS. 4 and 5 differ from the illustrative example according to FIGS. 3*a* and *b* thereby, that respectively one unidirectional drive hydraulic pump 42 is provided. The reversing of the hydraulic connections between the two drive cylinders occurs therein by the directional valve 58 provided in the pressure lines 38', 38", which is controllable via the position sensors 52', 52", and the correction sensor 54 and the control device 51 in the sense of FIGS. 3*a* and *b*. In the case of FIG. 4 a closed hydraulic circuit is shown; the oil return flows to the hydraulic pump. In the case of FIG. 5 an open hydraulic circuit is provided, in which oil is suctioned from a hydraulic tank 60 and the oil return is directed to the hydraulic tank 16. The hydraulic connections 40', 40" of the hydraulic pump equivalent to FIGS. 3*a* and *b* are located in the illustrative embodiments according to FIGS. 4 and 5 on the outlet side of the directional valve 58 facing towards the drive cylinders 24', 24".

In summary the following can be concluded: the invention relates to a thick matter pump, especially for delivering concrete. The thick matter pump comprises two delivery cylinders 10, which open into a material feed basin 14 via openings 12 situated on the face. The thick matter pump also comprises two hydraulic drive cylinders 24', 24" whose pistons 26, 30', 30", are rigidly interconnected in pairs via a shared piston rod 28. The drive cylinders 24', 24" are connected to a hydraulic reversing pump 42 via piston rod-side and piston head-side pump connections 34', 34"; 36', 36". In addition, they communicate with one another on their ends opposite the pump connections via a swing oil line 44. The drive cylinders and, with them, the delivery cylinders are driven in a push-pull manner via the reversing pump 42. In order to reverse the reversing pump 42, two position sensors 52', 52" are provided, which are arranged at a defined distance from one of the ends of the drive cylinders and which respond to a drive piston 30', 30" that is passing by. The object of the invention is to prevent the formation of concrete clots inside the delivery cylinders 10 as well as the occurrence of a slamming when the drive pistons 30', 30" reach their end of travel. To these ends, the invention provides that both position sensors 52', 52" are arranged at a distance from the rod-side ends of both drive cylinders 24', 24" and that, in addition, a correcting sensor 54 is arranged at a defined distance from the bottom-side end of one of the drive cylinder 24'. Said correcting sensor can be temporarily activated for initiating a reversing process overruling the rod-side position sensor 52" of the other drive cylinder 24".

What is claimed is:

1. A thick matter pump comprising:

two delivery cylinders (10) containing drive cylinders (24', 24"), which cylinders respectively open into a material feed basin (14) via openings (12) situated at one end;

two hydraulic drive cylinders (24', 24") containing drive pistons (30', 30"), each piston having a rod side and a head side, said cylinders connected to a reversible hydraulic pump (42) via piston rod-side or piston head-side pump connections (34', 34"; 36', 36");

a swing oil line (44) interconnecting the ends of the drive cylinders which are opposite to the pump connections;

piston rods (28) rigidly pair-wise connecting the drive pistons (30', 30") of the drive cylinders (24', 24") and the delivery pistons (26) of the delivery cylinders (10) respectively;

equalizing lines (48) connected in the area of the piston head ends of the two drive cylinders (24', 24") and forming a bridge between the head side and the rod side of the respective drive pistons (30', 30") when said drive pistons are at their respective end positions, said equalizing lines each containing a check valve (46); and two position sensors (52', 52"), wherein one of these position sensors is provided a defined distance from the rod-side end of each drive cylinder (24', 24"), and connected to a control device (51) and emitting an end position signal in response to the passing by of a drive piston (30', 30") for controlling the reversal of the hydraulic pump, such that the sensing of the piston by the position sensor triggers a reversing of the direction of the pistons, wherein, in addition, a correcting sensor (54) is arranged at a defined distance from the piston head-side end of one of the drive cylinders (24'), wherein said control device temporarily activates said correcting sensor (54) such that said correcting sensor is used in place of the rod-side position sensor (52") of the other drive cylinder (24") in order to initiate the piston reversing process, whereby a condition of piston stroke being too short or too long due to excess or insufficient hydraulic fluid is corrected by transfer of hydraulic fluid between the piston side and rod side of a piston near the correcting sensor via the equalizing line (48).

2. A thick material pump according to claim 1, wherein the correction sensor (54) is activateable respectively for one reversal process in defined time intervals.

3. A thick material pump according to claim 1, wherein the control device (51) includes a delay circuit or a processor with delay software for activation of the correction sensor (54).

4. A thick material pump according to claim 3, wherein the delay circuit or the delay software have a time constant, which corresponds to at least twice the stroke time of the drive piston.

5. A thick material pump according to claim 3, wherein the delay circuit is triggered by the absence of an end position signal of the correction sensors (54) and presence of an end position signal of the oppositely lying drive cylinder (24") associated position sensor (52") and is resettable upon occurrence of end position signal of the correction sensor.

6. A thick material pump according to claim 3, wherein the delay circuit is a re-triggerable time delay.

7. A thick material pump according to claim 1, wherein respectively two redundant piston rod-sided position sensors (52', 52") are provided.

8. A thick material pump according to claim 1, the position sensors (52', 52") and the correction sensor (54) are proximity switches or magnetic switches for detecting bypassage of the associated drive piston (30', 30") in the direction of the end position.

9. A thick material pump according to claim 1, wherein position sensors (52', 52") and the correction sensor (54) are signal emitters emitting end position signals during the passage by of the respective drive piston (30', 30") in the direction towards the end position.

10. A thick material pump according to claim 1, the hydraulic pump is in a reversing pump (42), in particular a slant disc axial piston pump.

11. A thick material pump according to claim 1, wherein hydraulic pump (42) conveys unidirectionally and that the pump connections (36', 36") of the drive cylinder (24', 24") are connected with the hydraulic pump (42) via a directional valve (58).

12. A thick material pump according to claim 1, wherein at least two parallel connected hydraulic pumps (42) are provided.

* * * * *